US006371723B1

(12) United States Patent
Grant et al.

(10) Patent No.: US 6,371,723 B1
(45) Date of Patent: Apr. 16, 2002

(54) SYSTEM FOR COUPLING A SHAFT TO AN OUTER SHAFT SLEEVE

(76) Inventors: Lloyd Grant, P.O. Box 1514, Bracebridge, Ontario (CA), P1L 1V6; Mark Reynolds, 7195 16$^{th}$ Line, RR1, Arthur, Ontario (CA), N0G 1A0

( * ) Notice: Subject to any disclaimer, the term of this patent is extended or adjusted under 35 U.S.C. 154(b) by 0 days.

(21) Appl. No.: 09/641,825

(22) Filed: Aug. 17, 2000

(51) Int. Cl.$^{7}$ ..... F01D 1/02
(52) U.S. Cl. ..... 415/200; 29/458
(58) Field of Search ..... 415/200, 216.1, 415/217.1; 416/244 R, 241 B; 428/325, 403; 29/522.1, 451, 458; 464/179, 404

(56) References Cited

U.S. PATENT DOCUMENTS 5,456,833 A 10/1995 Butcher et al.
6,162,279 A * 12/2000 Eckert ..... 75/678

* cited by examiner

*Primary Examiner*—F. Daniel Lopez
*Assistant Examiner*—J M McAleenan
(74) *Attorney, Agent, or Firm*—Wells St. John P.S.

(57) ABSTRACT

Disclosed is a shaft system particularly adapted for use in molten metal applications, such as injecting impellers, submersible molten metal pumps, and others. Embodiments of the shaft system contemplated by this invention very generally including a base shaft with an outer surface, a shaft sleeve composed of material adapted to be used in a molten metal environment, the shaft sleeve having an inner surface approximately corresponding in size to the outer surface of the shaft and located approximately concentrically around the shaft; and a shaft coupler between the outer surface of the shaft and the inner surface of the shaft sleeve; wherein the shaft sleeve is securely attached to the shaft by the expansion of the shaft coupler relative to the shaft and the shaft sleeve.

36 Claims, 9 Drawing Sheets

SYSTEM FOR COUPLING A SHAFT TO AN OUTER SHAFT SLEEVE

TECHNICAL FIELD

This invention pertains to a shaft coupling system for coupling a shaft, typically a graphite shaft, to an outer sleeve or outer surface. This invention is particularly useful in a molten metal environment.

BACKGROUND OF THE INVENTION

Molten metal may be one of the more difficult environments in which to maintain rotating and other equipment due to the heat and the corrosive factors within the molten metal. The submerged components of this equipment is typically made of graphite or similar materials due to the ability of these types of material compositions to withstand the heat and corrosive effects of the molten metal. While graphite and other similar materials withstand the molten metal well, they are susceptible to oxidation.

In order to utilize graphite and obtain its benefits in the molten metal in situations where oxygen is present above or around the molten metal, outer surfaces and/or outer sleeves are placed around the graphite where it may or will encounter oxygen. In shaft applications using graphite, typically an outer sleeve or outer surface of silicon carbide or of a ceramic will be used to completely surround and protect the graphite.

It should be noted and will be recognized by those of ordinary skill in the art that while references may be made herein to the molten aluminum environment, this is only used to give an example and not to limit the invention thereto since the system disclosed herein may be used in numerous other applications, including all molten metal applications, as well as in any other shaft coupling applications.

The outer sleeve or surface must somehow be fixed to the graphite shaft or other component being protected. In the typical situation, this is accomplished by manufacturing the outer sleeve or outer surface with an inner diameter which corresponds closely to the outer diameter of the shaft on which it will be attached. To install or attach the sleeve to the shaft, the shaft is typically covered with cement and the sleeve is then slid over the shaft. Then, when the cement dries, there is a solid attachment or coupling of the shaft to the outer sleeve/surface.

If air gaps are present between the shaft and the sleeve, the air gaps tend to cause cracks in the sleeves/outer surfaces. The air gaps cause graphite deterioration through oxidation, and ultimately leads to the failure of the shaft as oxidation is allowed to attack the graphite. The shaft must then be replaced.

Air gaps typically occur when the sleeve or outer surface is initially installed because as the sleeve is placed over the shaft (which is covered with cement), the sleeve tends to displace cement from some areas on the shaft despite the installers best efforts to avoid this situation.

The replacement or servicing of a shaft operating submersed in molten metal is a time consuming and expensive task. First, the shaft must be removed from the molten metal, thereby causing down time of the metal furnace if that is the operating environment. Then the shaft and other equipment must be allowed to sufficiently cool to allow it to be disassembled. Once the deteriorated components of a typical shaft are sufficiently cool, the molten metal built up on the various pump surfaces must be sufficiently removed to allow disassembly and/or re-use of the pump components. Then the pump must be reassembled with the combination of old components or parts, along with the replacement parts. The cost of downtime of a molten metal production line is very expensive and in addition to the actual repair costs.

It is therefore an object of this invention to provide an alternative way to couple, attach or secure the shaft to the outer sleeve or outer surface.

BRIEF DESCRIPTION OF THE DRAWINGS

Preferred embodiments of the invention are described below with reference to the following accompanying drawings.

FIG. 10 is an elevation view of a shaft system combined with an impeller attached to the shaft system, the shaft system and impeller/injector are immersed in the molten metal and are disposed to treat the molten metal.

DETAILED DESCRIPTION OF THE PREFERRED EMBODIMENTS

Figure 1:
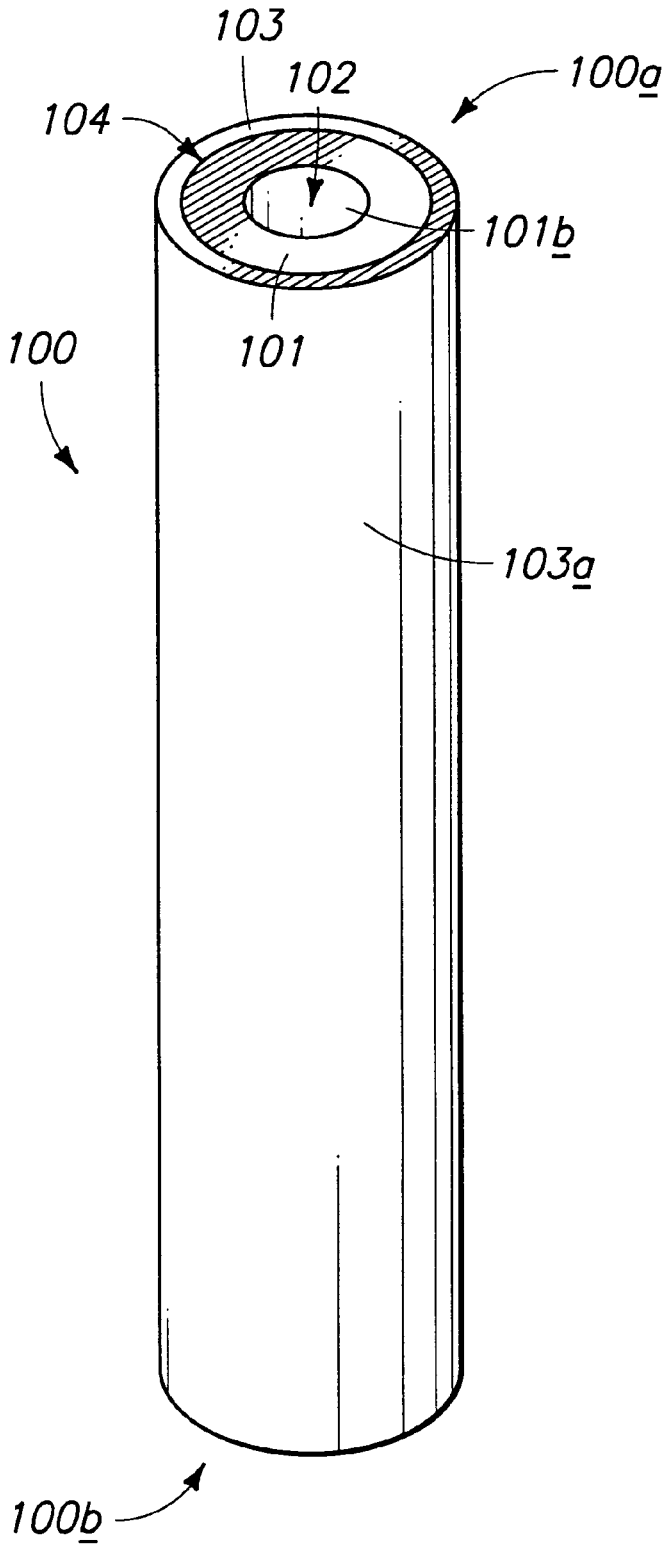
FIG. 1 is an elevation perspective view of a section of a molten metal shaft system, illustrating a base shaft and an outer shaft sleeve.

Many of the fastening, connection, manufacturing and other means and components utilized in this invention are widely known and used in the field of the invention described, their exact nature or type is not necessary for an understanding and use of the invention by a person skilled in the art or science, and they will not therefore be discussed in significant detail. Furthermore, the various components shown or described herein for any specific application of this invention can be varied or altered as anticipated by this invention and the practice of a specific application of any element may already be widely known or used in the art, or by persons skilled in the art or science, and each will not therefore be discussed in significant detail.

The terms "a", "an" and "the" as used in the claims herein are used in conformance with longstanding claim drafting practice and interpretation and not in a limiting way. Unless specifically set forth herein, the aforementioned terms are not limited to one of such items but instead are intended to mean "at least one".

The term shaft sleeve or outer shaft sleeve as used herein includes all outer surfaces which may be imparted or installed on a base shaft. In the one example of a molten aluminum environment, this would preferably be silicon carbide or a ceramic, preformed and placed over the base shaft as set forth more fully below.

The term shaft coupler as used herein includes pressure based couplers between the shaft sleeve and the base shaft and which utilize pressure on both the base shaft and the shaft sleeve as the basis for coupling the base shaft to the shaft sleeve. In the molten aluminum environment, the preferred shaft coupler is a vermiculite placed between the silicon carbide shaft sleeve and the graphite base shaft. The expansion of the vermiculite when exposed to heat causes it to expand in volume, thereby providing a pressure between the base shaft and the shaft sleeve, to effectively securely attach the two together.

The term approximately cylindrical as used herein not only includes the traditional smooth cylindrical surface, but also includes surfaces which are generally cylindrical and those which are suitable for the outer surface of a rotating shaft, for example. By way of example but not limitation, this term as used herein would include an outer surface which has a series of flat surfaces generally radially around the axis of the shaft (which may be, without limitation, octagonal).

While the term shaft is used herein, for example in the term base shaft, it is not limited to a rotating shaft. Instead the term shaft not only includes rotating shafts, but also includes non-rotating shafts such as posts and risers (as shown more fully in reference to FIG. 9, items 163 and 166). The post 163 merely being a support and the riser 166 including an internal conduit for pumping molten metal.

An embodiment of the shaft system contemplated by this invention includes a shaft adapted for use in molten metal, the shaft comprising: a shaft with an outer surface; a shaft sleeve composed of material adapted to be used in a molten metal environment, the shaft sleeve having an inner surface approximately corresponding in size to the outer surface of the shaft and located approximately concentrically around the shaft; and a shaft coupler between the outer surface of the shaft and the inner surface of the shaft sleeve; wherein the shaft sleeve is securely attached to the shaft by the expansion of the shaft coupler relative to the shaft and the shaft sleeve.

There are also process embodiments contemplated by this invention, namely: a process for making a shaft for use in molten metal, the process generally comprising the steps of: providing a shaft with an outer surface; providing a shaft coupler and placing the shaft coupler generally around the outer surface of the shaft; providing a shaft sleeve composed of material adapted to be used in a molten metal environment, the shaft sleeve having an inner surface approximately corresponding in size to the outer surface of the shaft; placing the shaft sleeve around and in close proximity to the shaft coupler, wherein a sufficient amount of shaft coupler is provided between the shaft and the shaft sleeve such that when the shaft is placed in molten metal, the shaft coupler expands sufficiently to attach the shaft sleeve to the shaft.

Another process embodiment entails placing the shaft sleeve around the base shaft first, and then placing the shaft coupling between the shaft sleeve and the base shaft. This can be done by physical insertion, injection or other known techniques. Then heat is applied to the shaft system, expanding the shaft coupling to create the necessary pressure to securely attach the shaft sleeve to the base shaft.

Examples of more particular, independent and additional process and apparatus embodiments, without limitation, include embodiments wherein: the shaft is comprised of graphite; the shaft sleeve is comprised of silicon carbide; the shaft sleeve is generally comprised of a ceramic; the outer surface of the base shaft is approximately cylindrical; the shaft coupler is composed of vermiculite; or the shaft and the shaft sleeve each have a first end and a second end, and wherein at least either the first end or the second end have cement interposed between the shaft and the shaft sleeve.

In the embodiment of this invention in which vermiculite is utilized as the shaft coupler, the water molecules within the internal structure of vermiculate transform into steam when heated to high temperatures, thereby causing the vermiculite particles to increase in volume.

In still further embodiments of the apparatus and processes contemplated by this invention, the shaft coupler (regardless of whether in a pump or other environment) is a pressure based bonding agent.

In still other embodiments of the apparatus and processes contemplated by this invention, the shaft coupler expands more than the shaft and/or the shaft sleeve, thereby achieving the coupling.

FIG. 1 is an elevation perspective view of a section of a molten metal shaft system 100 with a first end 100*a* and a second end 100*b*, illustrating a base shaft 101 with an inner base shaft aperture 102, an outer shaft sleeve 103 or surface with a shaft sleeve outer surface 103*a*, a shaft coupler 104. In the molten aluminum embodiment of this invention, it is preferred that the base shaft 101 be partially or wholly made of graphite, and the shaft sleeve 103 be composed of silicon carbide or a ceramic. The base shaft 101 may, but need not have a base shaft aperture 102. The base shaft aperture 102, as merely one example, may be used in the embodiment of this invention for the aluminum industry, to inject gas into the molten aluminum to treat the aluminum.

While it is preferred that the base shaft 101 be made of graphite, this invention contemplates that it may be made of any material or composition suitable for the application in which it is being used now or in the future, with no one in particular being required to practice the invention. Similarly, while the shaft sleeve is preferably composed of silicon carbide in the embodiment of this invention which will be used in molten aluminum, it also need not be and may be made of any material or composition suitable for the application in which it is being used now or in the future, with no one in particular being required to practice the invention. A ceramic is an example of another possibly suitable material or composition.

Figure 2:
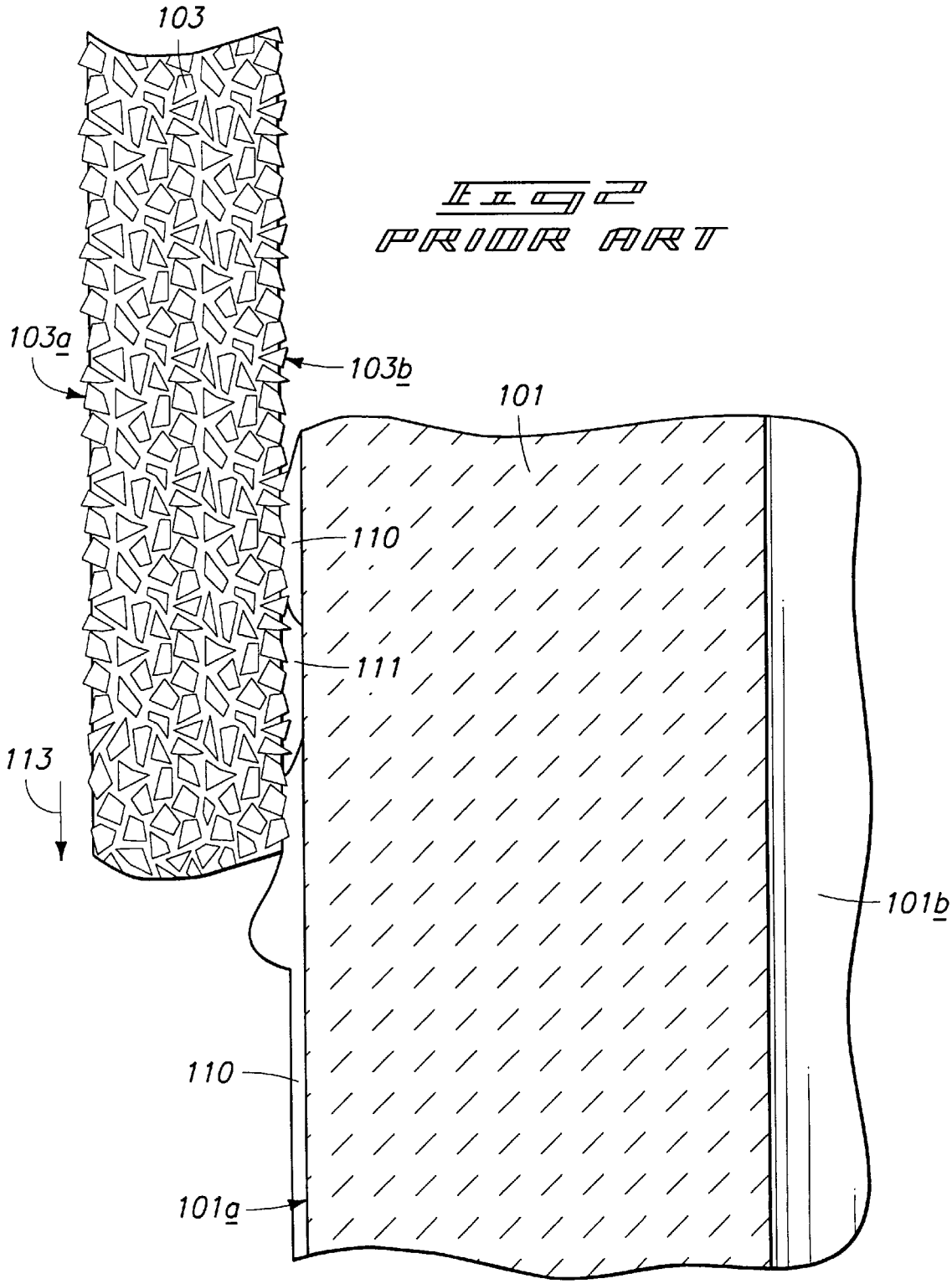
Fig 2 PRIOR ART
FIG. 2 is a detail section view of a typical prior art shaft illustrating how an air pocket may be created during the installation of the shaft sleeve.

FIG. 2 is a detail section view of a typical prior art molten metal shaft wherein cement was used as the sole or primary bonding agent. The base shaft 101 is shown with an inner surface 101*b* or aperture. The shaft sleeve 103, or outer surface or coating, is shown with an outer surface 103*a* (which is preferably approximately cylindrical), an inner surface 103*b* approximately corresponding in size to the outer surface of the base shaft 101 and which is located approximately concentrically around the base shaft 101.

FIG. 2 illustrates cement 110 which had been applied to the outer surface 101*a* of the base shaft 101, or which had been applied to the inner surface 103*a* of the shaft sleeve 103. As can be seen, as the shaft sleeve 103 is slid or placed on or over the base shaft 101 (in direction 113), cement is forced out of a pocket location between the base shaft 101 and the shaft sleeve 103, thereby creating an undesirable air pocket 111. As discussed above, air pockets 111 are undesirable as they better facilitate or allow oxidation and other degradation of the base shaft 101 in the harsh environment.

Figure 3:
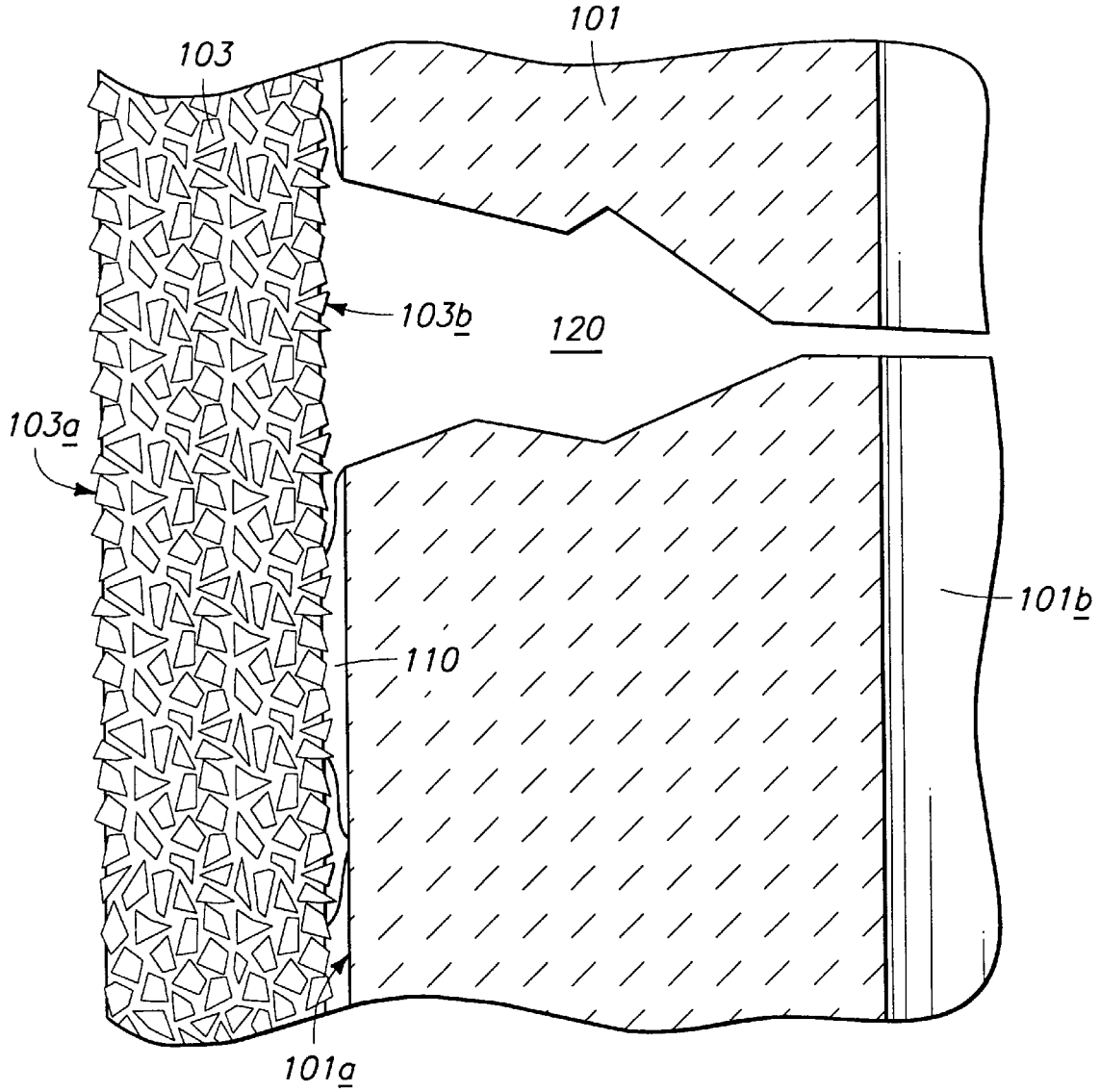
FIG 3 PRIOR ART
FIG. 3 is a detail section view of a typical prior art shaft in which an air pocket was created and has caused substantial oxidation and deterioration of the base shaft.

FIG. 3 is a detail section view of the typical prior art shaft shown in FIG. 2 (with like items being numbered identically), wherein cement 110 has been used to attach the base shaft 101 to the shaft sleeve 103. FIG. 3 illustrates how the air pocket 111 shown in FIG. 2 has allowed the oxidation or corrosion of base shaft 101. The cavity 120 in base shaft 101 will lead to failure or the need to replace the base shaft.

Figure 4:
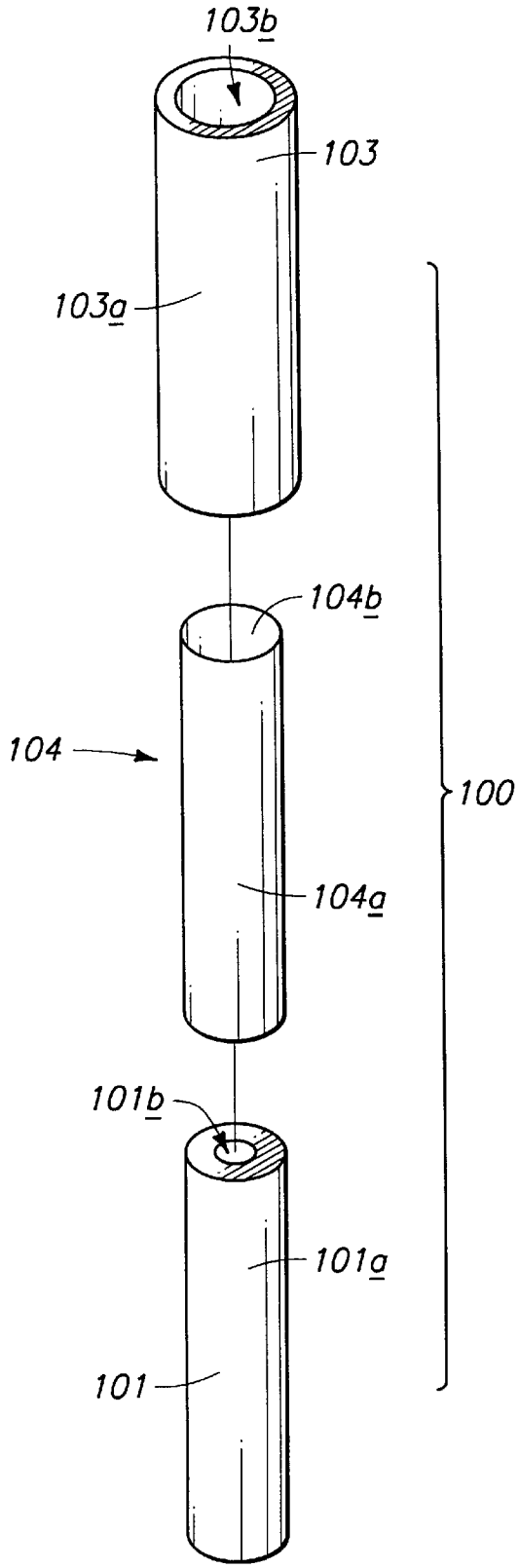
FIG. 4 is an elevation perspective exploded view of a section of one embodiment of a shaft system contemplated by this invention, illustrating the base shaft, the shaft coupler and the shaft sleeve or outer surface.

FIG. 4 is an elevation perspective exploded view of a section of one embodiment of this invention, illustrating the shaft system 100, which includes a base shaft 101 with base shaft outer surface 101*a* (which is preferably approximately cylindrical), outer shaft sleeve 103 with shaft sleeve outer surface 103*a* and shaft sleeve inner surface 103*b*, and shaft coupler 104. Shaft coupler 104 has shaft coupler outer surface 104*a* and shaft coupler inner surface 104*b*.

The preferred material contemplated by an embodiment of this invention for use in molten aluminum is vermiculite, which may be obtained from 3M Company, or from others. While the preferred shaft coupler composition is vermiculite, it is not necessary to use this particular material or composition, and other expandable material(s) or composition(s) which are suitable for the particular application (now or in the future), may be used, with no one in particular being required to practice the invention.

Figure 5:
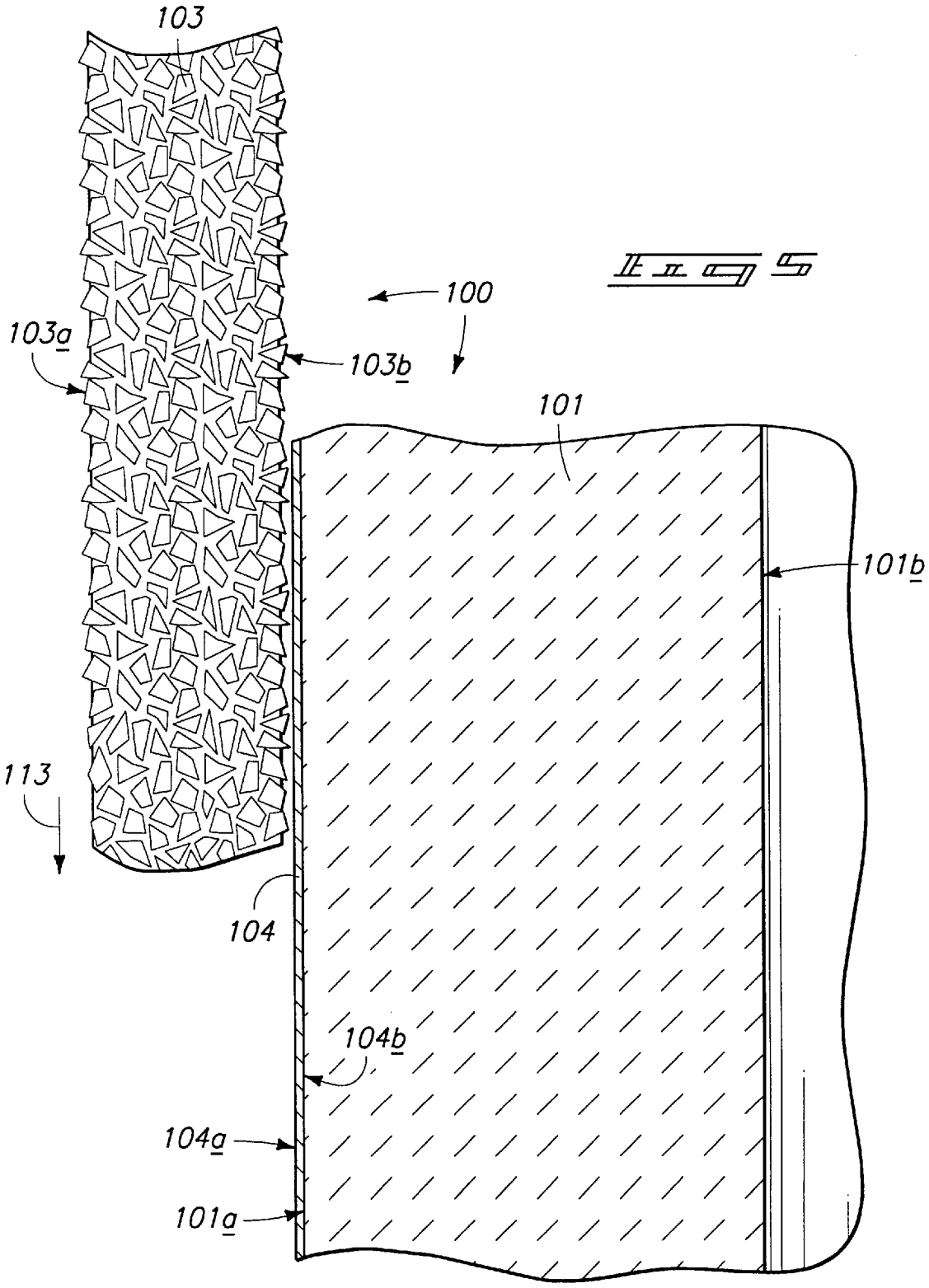
FIG. 5 is a detail section view of one embodiment of a section of a shaft system contemplated by this invention, illustrating the shaft coupler around the base shaft as the outer shaft sleeve is moved on to the base shaft and over the shaft coupler.

FIG. 5 is a detail section view of one embodiment of a section of a shaft system 100 contemplated by this invention, illustrating the shaft coupler 104 around the base shaft as the outer shaft sleeve 103 is moved on to the shaft over the shaft coupler 104 in direction 113. FIG. 5 also shows base shaft 101, base shaft outer surface 101*a*, base shaft inner surface 101*b*, shaft coupler inner surface 104*b*, shaft coupler outer surface 104*a*, shaft sleeve inner surface 103*b*, and shaft sleeve outer surface 103*a*.

Figure 6:
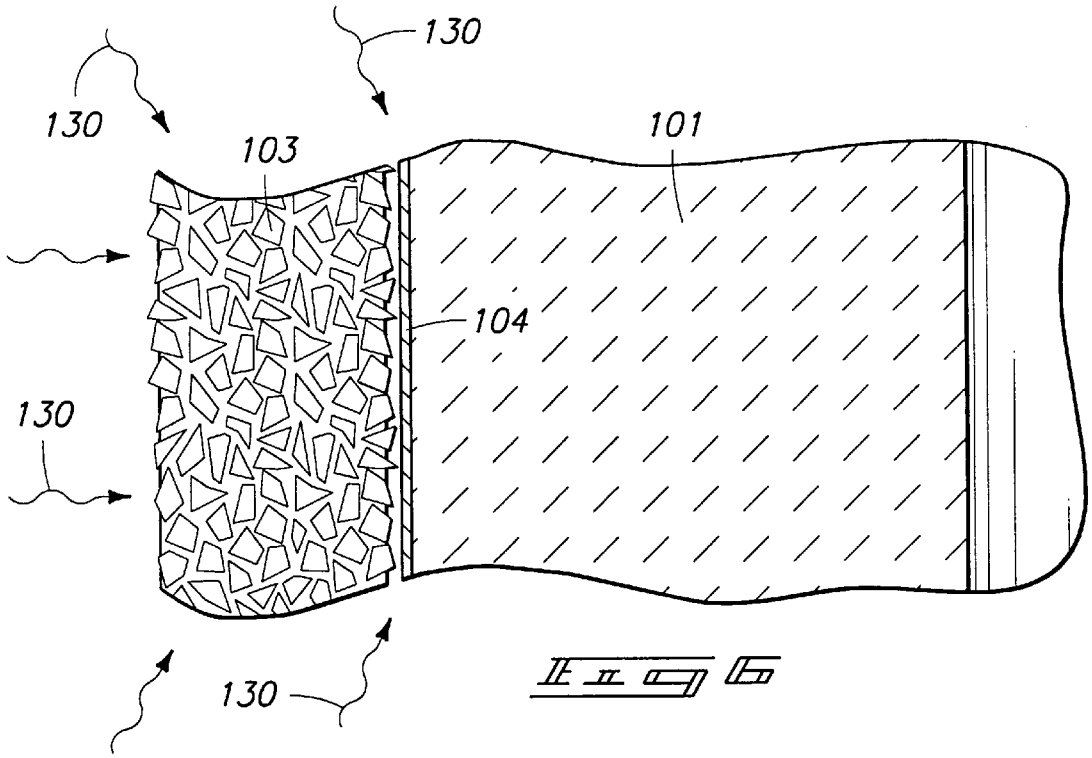
FIG. 6 is a detail section view of one embodiment of a section of a shaft system contemplated by this invention, illustrating heat being applied or received at the outer shaft sleeve, which will indirectly heat the shaft coupler and the base shaft.

FIG. 6 is a detail section view of one embodiment of a section of a shaft system contemplated by this invention, illustrating heat 130 or a temperature delta being applied to the outer shaft sleeve 103, and hence indirectly to the shaft coupler 104 and to base shaft 101.

Figure 7:
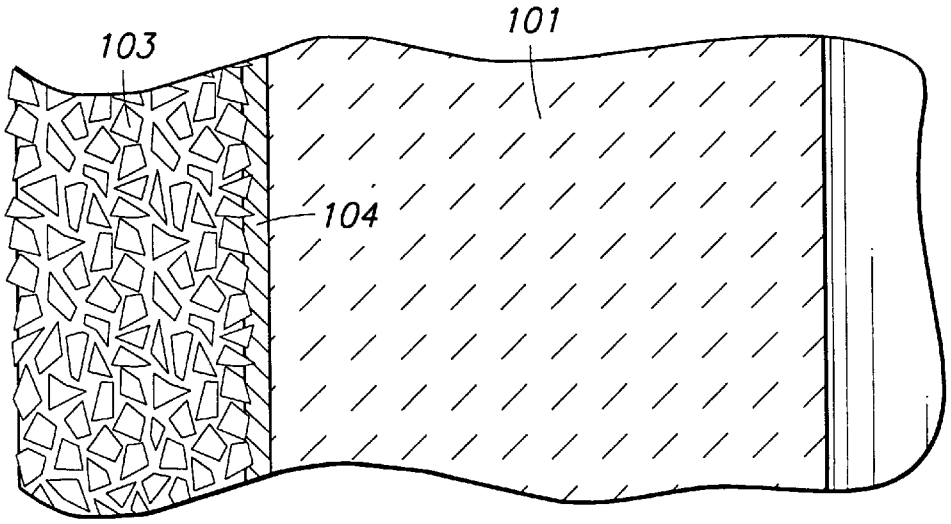
FIG. 7 is a detail section view of the embodiment shown in FIG. 6, illustrating the shaft coupler expanded between and effectively coupling/attaching the base shaft and the outer shaft sleeve.

FIG. 7 is a detail section view of the embodiment shown in FIG. 6, illustrating the shaft coupler 104 expanded between and effectively coupling/attaching the base shaft 101 to the outer shaft sleeve 103.

Figure 8B:
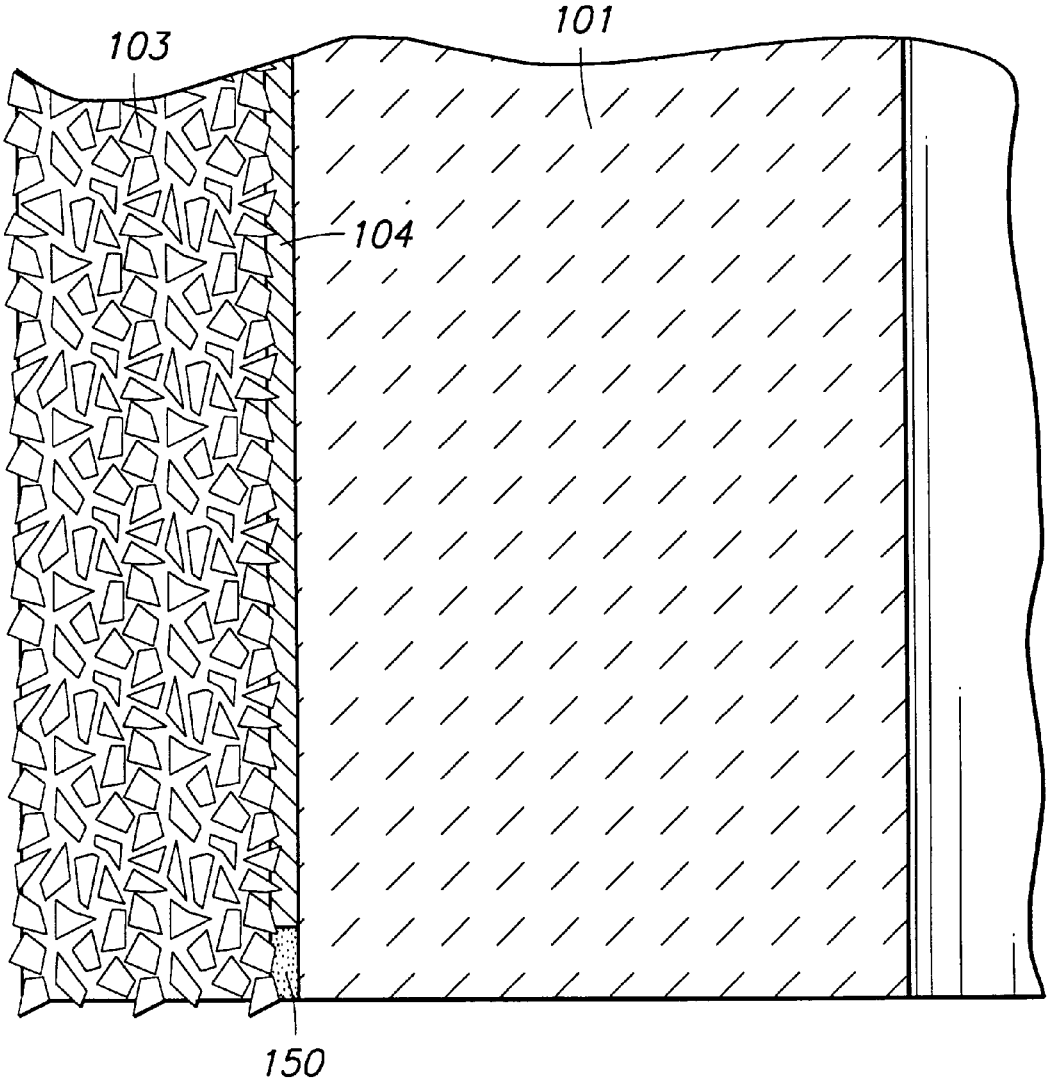
FIG. 8 is a detail section view of an embodiment of the invention, illustrating an end of the shaft system where cement has also been applied between the base shaft and the outer shaft sleeve, but only at an end of the shaft system.

FIG. 8 is a detail section view of an embodiment of the invention, illustrating an end of the shaft system where cement 150 has been applied between the base shaft 101 and the outer shaft sleeve 103, but only an end of the shaft system. This may help secure the base shaft 101 to the shaft sleeve 103 when there is insufficient heat or temperature delta. FIG. 8 further shows the shaft coupler 104 expanded between and effectively coupling/attaching the base shaft 101 to the outer shaft sleeve 103.

Figure 9:
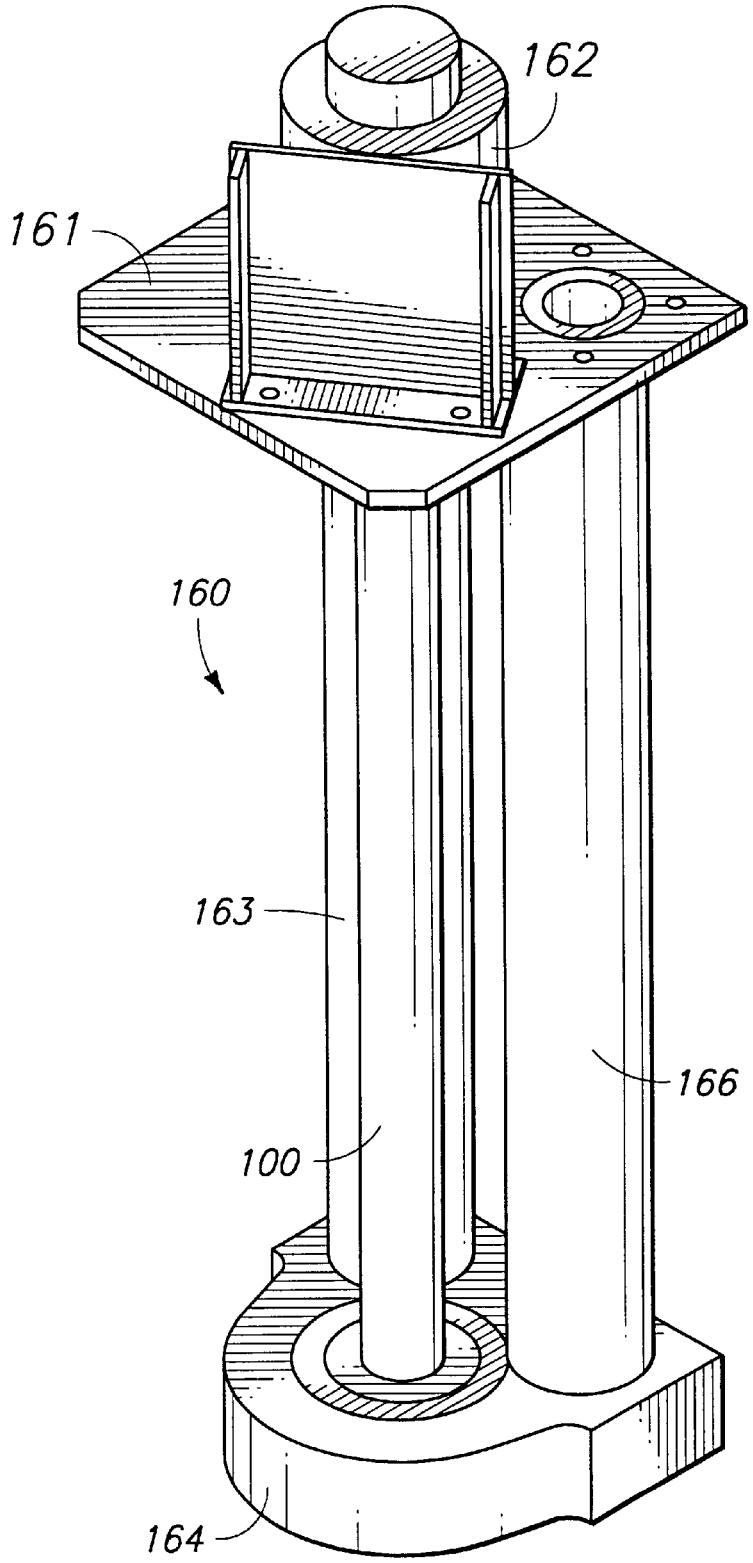
FIG. 9 is a perspective view of a typical partial submersible molten metal pump system, and including a shaft system combined with and utilized in a pump system, as contemplated by this invention.
Figure 11:
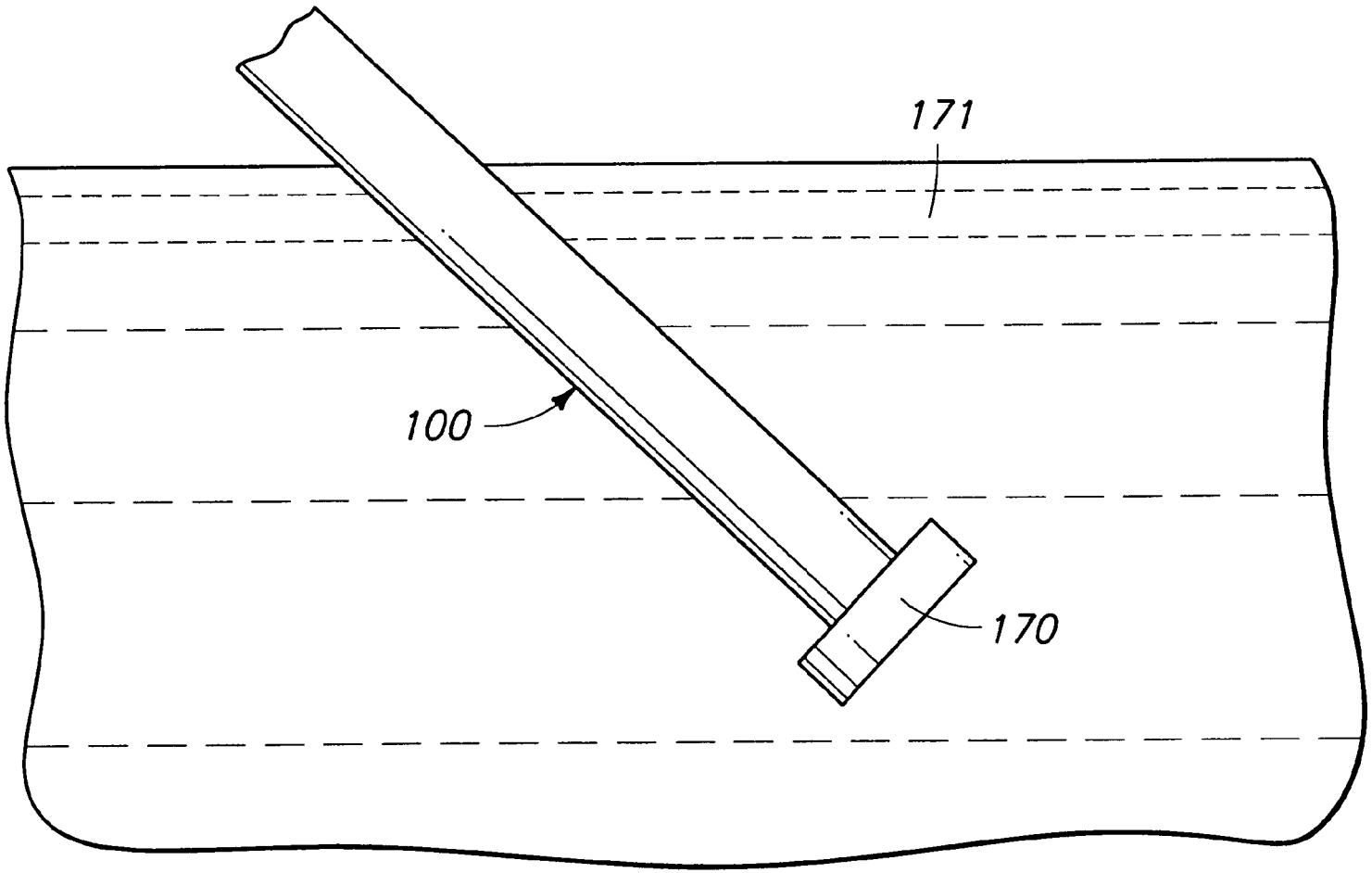

FIG. 9 is a perspective view of a typical partial submersible molten metal pump system 160, and which is provided to illustrate one of numerous possible environments and applications for embodiments of the shaft system contemplated by this invention. FIG. 9 shows shaft system 100, pump motor mount 161, pump base 164, pump support 163 (also known as a post), pump riser 166 (a structure which includes an internal conduit through which molten metal may be pumped) all of which are widely known by those of ordinary skill in the art and will not therefore be discussed in significant detail.

FIG. 10 is an elevation view of an embodiment of shaft system 100 contemplated by this invention, wherein the shaft system 100 is shown in another one of numerous possible environments and applications for embodiments of the shaft system contemplated by this invention. FIG. 10 illustrates the shaft system 100 combined with or attached to impeller 170 in molten metal 171.

EXAMPLE

A shaft system was made by starting with a graphite shaft of an outer diameter of 3.850 inches, the outer surface being generally cylindrical. A shaft coupler was then applied around the shaft on the outer surface of the shaft, the shaft coupler being a vermiculite available through the 3M Company and others. The shaft coupler was applied at an approximate uniform thickness of one-eighth (⅛) of an inch.

A shaft sleeve with an approximate 4.065 inches inner diameter or surface and an approximate 4.500 inches outer diameter surface, was thereafter slid or placed over the shaft and shaft coupler until positioned as desired. Cement such as that made by and known as Greenset 85P was then applied to approximately one-half inches of both ends of the shaft.

The combined shaft, shaft coupler and shaft sleeve were then subjected to heat at the approximate temperature of eight hundred degrees (800° F.), thereby causing the shaft couple to expand relative to the shaft and the shaft sleeve. The shaft sleeve was thereby securely attached to the shaft.

The above shaft coupling system was operated within molten metal, aluminum to be specific, for two hundred ten (210) days without any failures, in an environment wherein a failure may be expected in approximately sixty (60) days.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A shaft system adapted for use in molten metal, the shaft system comprising:

(a) a base shaft with an outer surface;

(b) a shaft sleeve composed of material adapted to be used in a molten metal environment, the shaft sleeve having an inner surface approximately corresponding in size to the outer surface of the base shaft and located approximately concentrically around the base shaft; and (c) a shaft coupler between the outer surface of the base shaft and the inner surface of the shaft sleeve;

wherein the shaft sleeve is securely attached to the base shaft by the expansion of the shaft coupler relative to the base shaft and the shaft sleeve.

2. A shaft system as recited in claim 1, and further wherein the base shaft is comprised of graphite.

3. A shaft system as recited in claim 1, and further wherein the shaft sleeve is comprised of silicon carbide.

4. A shaft system as recited in claim 1, and further wherein the shaft sleeve is comprised of a ceramic.

5. A shaft system as recited in claim 1, and further wherein the outer surface of the base shaft is approximately cylindrical.

6. A shaft system as recited in claim 1, and further wherein the shaft coupler is composed of vermiculite.

7. A shaft system as recited in claim 1, and further wherein the base shaft and the shaft sleeve each have a first end and a second end, and wherein at least either the first end or the second end have cement interposed between the base shaft and the shaft sleeve.

8. A shaft system adapted for use in molten metal, the shaft system comprising:

(a) a base shaft with an outer surface having a base shaft coefficient of expansion when subjected to a temperature delta;

(b) a shaft sleeve composed of material adapted to be used in a molten metal environment, the shaft sleeve having an inner surface approximately corresponding in size to the outer surface of the base shaft and located approximately concentrically around the base shaft, and the shaft sleeve having a shaft sleeve coefficient of expansion when subjected to a temperature delta; and (c) a shaft coupler between the outer surface of the base shaft and the inner surface of the shaft sleeve, having a shaft coupler coefficient of expansion when subjected to a temperature delta;

wherein the shaft sleeve is securely attached to the base shaft by the imposition of a temperature delta to the shaft sleeve, the base shaft and the shaft coupler.

9. A shaft system as recited in claim 8, and further wherein the base shaft is comprised of graphite.

10. A shaft system as recited in claim 8, and further wherein the shaft sleeve is comprised of silicon carbide.

11. A shaft system as recited in claim 8, and further wherein the shaft sleeve is comprised of a ceramic.

12. A shaft system as recited in claim 8, and further wherein the outer surface of the base shaft is approximately cylindrical.

13. A shaft system as recited in claim 8, and further wherein the shaft coupler is composed of vermiculite.

14. A shaft system as recited in claim 8, and further wherein the base shaft and the shaft sleeve each have a first end and a second end, and wherein at least either the first end or the second end have cement interposed between the base shaft and the shaft sleeve.

15. A shaft system adapted for use in molten metal, the shaft system comprising:

(a) a base shaft with an outer surface;

(b) a shaft sleeve composed of material adapted to be used in a molten metal environment, the shaft sleeve having an inner surface approximately corresponding in size to the outer surface of the base shaft and located approximately concentrically around the base shaft; and (c) a shaft coupler between the outer surface of the base shaft and the inner surface of the shaft sleeve, the shaft coupler being a pressure based bonding agent between the base shaft and the shaft sleeve.

16. A shaft system as recited in claim 15, and further wherein the base shaft is comprised of graphite.

17. A shaft system as recited in claim 15, and further wherein the shaft sleeve is comprised of silicon carbide.

18. A shaft system as recited in claim 15, and further wherein the shaft sleeve is comprised of a ceramic.

19. A shaft system as recited in claim 15, and further wherein the outer surface of the base shaft is approximately cylindrical.

20. A shaft system as recited in claim 15, and further wherein the shaft coupler is composed of vermiculite.

21. A shaft system as recited in claim 15, and further wherein the base shaft and the shaft sleeve each have a first end and a second end, and wherein at least either the first end or the second end have cement interposed between the base shaft and the shaft sleeve.

22. A submersible molten metal pump comprising:

(a) a pump framework, including a motor mount and a pump base;

(b) a pump motor mounted on the framework motor mount;

(c) a pump shaft system operative coupled to the pump motor, the pump shaft system comprising:

(i) a base shaft with an outer surface;

(ii) a shaft sleeve composed of material adapted to be used in a molten metal environment, the shaft sleeve having an inner surface approximately corresponding in size to the outer surface of the base shaft and located approximately concentrically around the base shaft; and (iii) a shaft coupler between the outer surface of the base shaft and the inner surface of the shaft sleeve;

wherein the shaft sleeve is attached to the base shaft by the expansion of the shaft coupler; and (d) an impeller operatively coupled to the pump shaft system.

23. A submersible molten metal pump as recited in claim 22, and further wherein the base shaft is comprised of graphite.

24. A submersible molten metal pump as recited in claim 22, and further wherein the shaft sleeve is comprised of silicon carbide.

25. A submersible molten metal pump as recited in claim 22, and further wherein the shaft sleeve is comprised of a ceramic.

26. A submersible molten metal pump as recited in claim 22, and further wherein the outer surface of the base shaft is approximately cylindrical.

27. A submersible molten metal pump as recited in claim 22, and further wherein the shaft coupler is composed of vermiculite.

28. A submersible molten metal pump as recited in claim 22, and further wherein the base shaft and the shaft sleeve each have a first end and a second end, and wherein at least either the first end or the second end have cement interposed between the base shaft and the shaft sleeve.

29. A process for making a shaft system for use in molten metal, the process comprising the following steps:

(a) providing a base shaft with an outer surface;

(b) providing a shaft coupler and placing the shaft coupler generally around the outer surface of the base shaft;

(c) providing a shaft sleeve composed of material adapted to be used in a molten metal environment, the shaft sleeve having an inner surface approximately corresponding in size to the outer surface of the base shaft;

(d) placing the shaft sleeve around and in close proximity to the shaft coupler;

(e) applying heat to the shaft system such that the shaft coupler expands sufficiently to securely affix the shaft sleeve to the base shaft.

30. A process for making a shaft system for use in molten metal as recited in claim 29, and further wherein the base shaft is comprised of graphite.

31. A process for making a shaft system for use in molten metal as recited in claim 29, and further wherein the shaft sleeve is comprised of silicon carbide.

32. A process for making a shaft system for use in molten metal as recited in claim 29, and further wherein the shaft sleeve is comprised of a ceramic.

33. A process for making a shaft system for use in molten metal as recited in claim 29, and further wherein the outer surface of the base shaft is approximately cylindrical.

34. A process for making a shaft system for use in molten metal as recited in claim 29, and further wherein the shaft coupler is composed of vermiculite.

35. A process for making a shaft system for use in molten metal as recited in claim 29, and further wherein the base shaft and the shaft sleeve each have a first end and a second end; and further apply cement between the base shaft and the shaft sleeve on at least either the first end or the second end.

36. A process for making a shaft system for use in molten metal, the process comprising the following steps:

(a) providing a base shaft with an outer surface;

(b) providing a shaft sleeve composed of material adapted to be used in a molten metal environment, the shaft sleeve having an inner surface approximately corresponding in size to the outer surface of the base shaft;

(c) placing the shaft sleeve around the base shaft;

(d) placing a shaft coupler between the outer surface of the base shaft and the inner surface of the shaft sleeve; and (e) applying heat to the shaft system such that the shaft coupler expands sufficiently to securely affix the shaft sleeve to the base shaft.

* * * * *